US008687234B2

(12) United States Patent
Nishi

(10) Patent No.: US 8,687,234 B2
(45) Date of Patent: Apr. 1, 2014

(54) IMAGE FORMING APPARATUS

(75) Inventor: Youichirou Nishi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 131 days.

(21) Appl. No.: 13/468,565

(22) Filed: May 10, 2012

(65) Prior Publication Data

US 2012/0287450 A1 Nov. 15, 2012

(30) Foreign Application Priority Data

May 13, 2011 (JP) ..... 2011-107984

(51) Int. Cl.
*G06K 1/00* (2006.01)
*B41J 29/38* (2006.01)

(52) U.S. Cl.
USPC ..... 358/1.9; 347/9

(58) Field of Classification Search
USPC ..... 358/1.9; 347/9
See application file for complete search history.

(56) References Cited

U.S. PATENT DOCUMENTS 8,500,227 B2 * 8/2013 Fujinaga ..... 347/9

FOREIGN PATENT DOCUMENTS

JP 2008-65025 3/2008
JP 2009-173356 8/2009

* cited by examiner

*Primary Examiner* — Charlotte M Baker
(74) *Attorney, Agent, or Firm* — Finnegan, Henderson, Farabow, Garrett & Dunner, L.L.P.

(57) ABSTRACT

An image forming apparatus includes a first image forming section to form a first image onto an image carrier and transfer the first image onto the paper, a paper humidifying section to humidify at least the first image transferred paper, a humidity switching section to switch to be humidified or not by the paper humidifying section, a second image forming section to form a second image onto the image carrier and transfer the second image onto the paper, a paper transport section to transport the paper from the first image forming section to the second image forming section, and a control section to control the first and second image forming sections, wherein the control section is operated to switch the image formation control at the second image forming section, depending on whether the paper is to be humidified or not.

11 Claims, 5 Drawing Sheets

IMAGE FORMING APPARATUS

BACKGROUND OF THE INVENTION

1. Field of the Invention

The present invention relates to an image forming apparatus to form an image onto an image carrier and transfer the image onto a paper, wherein the image forming apparatus includes a paper humidifying section.

2. Description of the Related Art

In the image forming apparatus such as a copying machine, a printer machine, a facsimile machine and a multifunction machine, an image is formed onto the image carrier such as the photoreceptor or the like, the image is then transferred onto a paper through the image transferring section, and the transferred image is finally fixed by the fixing device. For this image forming apparatus, furthermore, the image can be formed onto either of the front and rear side of the paper. After the image has been transferred onto one side of the paper and then fixed there, the paper is reversed so that the image can be transferred onto the other side of the paper and then fixed there.

For the imaging forming apparatus, it is known to the prior art that the paper is humidified so that any curls that may occur on the paper after the paper has been fixed the toner can easily be corrected and so that any reduction that may occur in the image transferring efficiency of the paper can be compensated for (see the patent documents 1 and 2).

In the patent document 1, it is proposed that the image forming apparatus includes a humidifying section that supplies moisture onto the paper at any appropriate humidity that can be adjusted, and a resistance measuring section that measures the electrical resistance of the paper, wherein the image forming apparatus is capable of controlling the humidity of the humidifying section based on the results obtained by measuring the resistance at the resistance measuring section.

In the patent document 2, it is proposed that the image forming apparatus includes a humidifying section that adds water to the paper on which the image has been formed, a switching section that determines whether the humidifying section should be switched or not to the humidifying process for the above paper, and a control section that controls the switching actions of the switching section, wherein the control section determines whether the humidifying section should be operated to humidify the paper based on the information regarding the image, and controls the switching actions of the switching section based on the results obtained from the above determination.

The following is a related patent documents that are opened for public examination and are cited herein as appropriate:

Patent document 1: Japanese Unexamined Patent Application Publication No, 2008-65025

Patent document 2: Japanese Patent Application Publication No. 2009-173356

SUMMARY OF THE INVENTION

Problems to be Solved by the Invention

It is noted, however, that the image forming apparatus that performs humidifying process has the following problems that are to be solved.

For the image forming apparatus that is configured to include the function that allows the paper to be humidified while the image is being formed before onto the rear side and after on to the front of paper, there is a problem in that the size of the paper will be changed to a different size while the image is being formed onto the rear side of the paper, depending on whether the paper is to be humidified or not. When the scaling factor for the image size is adjusted on the front and the rear sides of the paper under the paper is not to be humidified, for example, the paper will be expanded when it is humidified after the image has been formed onto the front side of the paper, causing the image sizes on the front and rear sides of the paper to be mismatched (the image size become smaller relative to the paper). When the scaling factor for the image size is adjusted on the front and the rear sides of the paper under the paper is to be humidified, the effect may be reversed when the image is formed where the paper is not to be humidified.

There is another problem in that the resistance of the paper may be varied, depending on whether the paper is to be humidified or not to be humidified. When the transferring electric current is adjusted under the paper is not to be humidified, for example, the resistance of the paper may become lower when the paper is humidified after the image has been formed onto the front side of the paper, causing the transferring efficiency to be varied and thus causing the defective image to occur.

Based upon the above observation, it is desirable that the paper should be humidified, but when the type of the paper, the basis weight and the coverage rate is considered, it is preferred that the paper should not be humidified. When the paper is humidified when the image of the high coverage rate is being formed onto the front side of the paper, the moisture will not be absorbed so much on the front side of the paper whereas the humidity on the rear side of the paper will become excessively high, which may cause the creases to be created on the paper at the toner fixing section when the image is being formed on the rear side of the paper.

For the conventional image forming apparatus, the switching action occurs between where the paper is to be humidified and where the paper is not to be humidified so that any creases on the paper can be removed or any defective image can be prevented, but it is impossible to control the image formation depending on whether the paper is to be humidified or not to be humidified.

Based on the situation and context described above, at least an object of the present invention is to provide an image forming apparatus that is operated to switch the image formation control depending on whether the paper is to be humidified or not to be humidified so that the wrong image size and the defective image can be prevented, thereby enabling the good image to be formed.

Means of Solving to Problems

On the first aspect of the present invention, it provides an image forming apparatus that includes a first image forming section to form a first image onto an image carrier and transfer the formed first image onto a paper, a paper humidifying section to humidify the paper onto which at least the first image has been transferred, a humidity switching section operated to switch between where the paper is to be humidified and where the paper is not to be humidified by the paper humidifying section, a second image forming section to form a second image onto the image carrier and transfer the formed second image onto the paper, a paper transporting section to transport the paper from the first image forming section to the second image forming section, and a control section to control the first image forming section and second image forming section wherein the control section is operated to switch the image formation control at the second image forming section depending on whether the paper is to be humidified or not at the paper humidifying section.

On the second aspect of the present invention based on the first aspect of the present invention, it provides the image forming apparatus that the first image forming section and the second image forming section are provided to share one common image forming section, and the paper transport section is operated so that the paper discharged from the image forming section and reversed the front and the rear side by a paper reversing section can be transported through the paper reversing section back to the common image forming section in which the image can be formed onto the paper.

On the third aspect of the present invention based on the first or second aspect of the present invention, it provides the image forming apparatus that the paper transport section includes a paper reversing section to reverse the front and the rear side of the paper.

On the fourth aspect of the present invention based on any one of the first, second and third aspects of the present invention, it provides the image forming apparatus that the control section is operated to permit the size of the second image to be changed, depending on whether the paper is to be humidified or not by the paper humidifying section.

On the fifth aspect of the present invention based on the fourth aspect of the present invention, it provides the image forming apparatus that the size of the second image is changed so that the size of the second image can become relatively smaller where the paper is not to be humidified and can become relatively larger where the paper is to be humidified.

On the sixth aspect of the present invention based on any one of the first, second, third, fourth and fifth aspects of the present invention, it provides the image forming apparatus that the control section is operated so that the magnitude of the transferring electric current through the transferring section in the second image forming section can be switched to become larger or smaller, depending on whether the paper is to be humidified or not by the paper humidifying section.

On the seventh aspect of the present invention based on the sixth aspect of the present invention, it provides the image forming apparatus that the magnitude of the transferring electric current is switched so that the transferring electric current through the second image forming section can become relatively larger where the paper is not to be humidified, and can become relatively smaller where the paper is to be humidified.

On the eighth aspect of the present invention based on any one of the first, second, third, fourth, fifth, sixth and seventh aspects of the present invention, it provides the image forming apparatus that a display and operation section is further included wherein the display and operation section accepts the entering by the operator, and the display and operation section includes a function that allows the image formation control by the second image forming section to be set, depending on whether the paper is to be humidified or not by the paper humidifying section.

On the ninth aspect of the present invention based on the eighth aspect of the present invention, it provides the image forming apparatus that the display and operation section includes a function that allows the scaling factor of the first image and the scaling factor of the second image to be set respectively, depending on whether the paper is to be humidified or not to be humidified.

On the tenth aspect of the present invention based on the eighth or ninth aspect of the present invention, it provides the image forming apparatus that the display and operation section includes a function that allows the magnitude of the transferring electric current through the first image forming section and the magnitude of the transferring electric current through the second image forming section to be set respectively, depending on whether the paper is to be humidified or not to be humidified.

On the eleventh aspect of the present invention based on the any one of the eighth, ninth and tenth aspect of the present invention, it provides the image forming apparatus that the control section is operated to permit the image formation control at the second image forming section to be switched, depending on the setting at the display and operation section.

DESCRIPTION OF THE EMBODIMENTS

One embodiment of the present invention is now described below.

Figure 1:
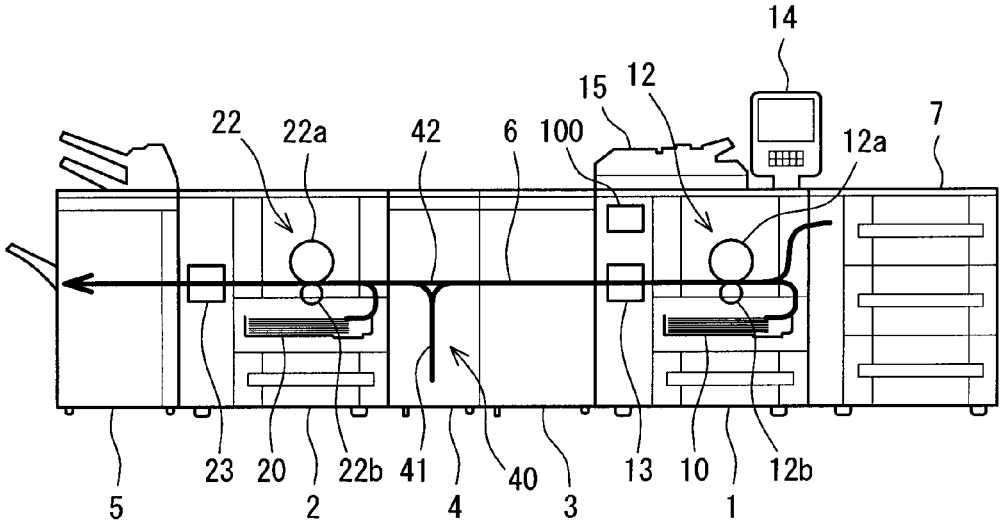
FIG. 1 is a diagram that illustrates the general construction of the image forming apparatus in accordance with one embodiment of the present invention.
Figure 2:
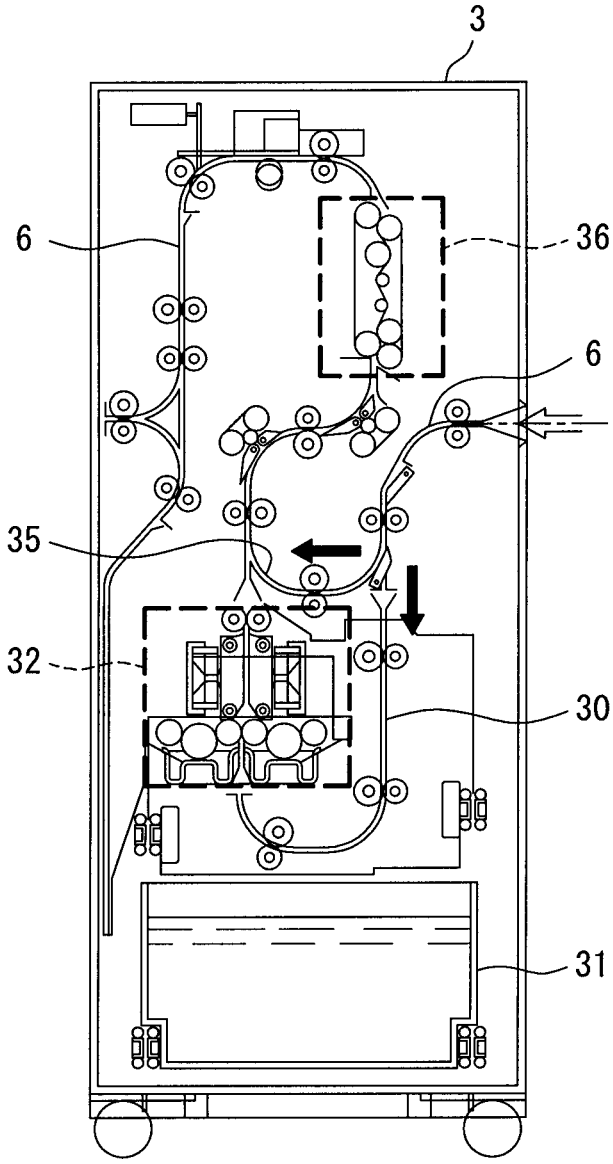
FIG. 2 is a cross-sectional diagram that shows the details of a de-curler unit included in the image forming apparatus.

As its general construction is shown in FIG. 1, the image forming apparatus comprises a first image forming apparatus main body 1 and a second image forming apparatus main body 2, between which a humidifying de-curler unit 3 and a the paper reversing and discharging unit 4 are disposed in this order and arranged in the paper transporting direction. A post-processing apparatus 5 is operatively connected to the subsequent stage of the second image forming apparatus main body 2. A paper transport section 6 is provided for transporting a paper from inside the first image forming apparatus main body 1 to the humidifying de-curler unit 3, the paper reversing and discharging unit 4, the second image forming apparatus main body 2 and the post-processing apparatus 5.

The first image forming apparatus main body 1 has a paper feeding tray 10 inside it and a large-capacity paper feeding tray 7 outside it. Papers can be fed from either the paper feeding tray 10 or the large-capacity paper feeding tray 7. The paper that is fed from either the paper feeding tray 10 or the large-capacity paper feeding tray 7 is transported by the paper transport section 6. Note that the large-capacity paper feeding tray 7 may be omitted.

The first image forming apparatus main body 1 includes a first image forming section 12 and a toner fixing section 13 which are disposed in this order along the transport path of the paper transport section 6.

The first image forming section 12 includes a photoreceptor drum 12*a* serving as the image carrier, a image transferring section 12*b* as well as an electrically charging section, a light exposure section, an image developing section and a cleaning section all of which are not shown. An image is thus formed and the formed image is then transferred onto the paper.

As this is described specifically, the photoreceptor drum 12*a* is electrically charged by the electrically charging section, and the light exposure section irradiates light onto the photoreceptor drum 12*a* according to the image data. An electrostatic latent image is thus formed on the photoreceptor drum 12*a*. During this process, the image data that has been adjusted to the appropriate scaling factor can be generated. In the image developing section, the electrostatic latent image is developed by applying the electrically charged toner onto the photoreceptor drum 12*a* having the electrostatic latent image formed thereon. From the photoreceptor drum 12*a* having the toner applied by the image developing section, the toner-applied image is transferred on the paper at the transferring position in which the transferring section 12*b* is disposed. After the toner-applied image has been transferred from the photoreceptor drum 12*a* onto the paper, any electrical charge or any toner that may remain on the photoreceptor drum 12*a* is removed by the cleaning section.

The paper having the image transferred thereon goes to the toner fixing section 13 where it is heated and its image is fixed, from which it is then delivered to the humidifying de-curler unit 3 provided on the subsequent stage.

Although, an image forming apparatus may be configured by a single image forming apparatus main body as well as any post processing device connected in series with the single image forming apparatus. The image forming apparatus may be configured by two or more image forming apparatuses main body.

The first image forming section and the second image forming may be provided inside the single image forming apparatus main body, but it may be possible that each of the first and second image forming sections is provided inside a different image forming apparatus main body.

Furthermore, it is possible that each of the first and second image forming sections is configured to include a different image forming section, but it may be possible that both the first and second image forming sections are configured to include the same image forming section. In this case, the first image is formed and transferred onto the paper at the first image forming section, and if the paper is to be humidified, the second image is then formed and transferred onto the paper at the second image forming section after the paper is humidified.

It may be appreciated from the foregoing description that the first image forming section has been described as the monochrome image forming section, but the first image forming section may be the color image forming section. In the color image forming section, the photoreceptor drum as image carrier, the electrically charging section, the light exposure section, the image developing section, the cleaning section and the like are provided for each of the colors. In addition, it is provided that the intermediate image transferring section to transfer the image provided on the photoreceptor drum and the secondary image transferring section to transfer the image on the paper from the intermediate image transferring section are also provided.

The intermediate image transferring section corresponds to the image carrier of the present invention, and the secondary image transferring section corresponds to the image transferring section of the present invention.

In addition, the first image forming apparatus main body 1 includes the display and operation section 14. The display and operation section 14 serves as a touch panel using the LCD and has the display function and the operating function.

In according with the present invention, it is not required that the display and operation section 14 should be provided in the first image forming apparatus main body 1. Otherwise, it may be provided in the second image forming apparatus main body 2, for example, and it may be provided so that it can be moved between the first image forming apparatus main body 1 and the second image forming apparatus main body 2.

Furthermore, the first image forming apparatus main body 1 includes a document feeder (DF) 15 that enables the documents thereon to be loaded and fed automatically. The documents are fed by the document feeder (DF) and read by the scanner provided in the first image forming apparatus main body 1 and then the image data can be generated.

Now, the humidifying de-curler unit 3 is described below in further details.

The transport section 6 is provide within the humidifying de-curler unit 3, and receives and transports the paper out of the first image forming apparatus main body 1. The transport section 6 is separated into a first transport section 30 and a second transport section 35 within the humidifying de-curler unit 3, and the first and second transport sections 30 and 35 are switched so that paper s can be transported onto either of the first and second transport sections.

On the side of the first transport section 30, there are a water supply tank 31 and a paper humidifying section 32 that accepts moisture from the water supply tank 31 and adds the moisture onto the paper.

The first transport section 30 and the second transport section 35 which are separated each other, are joined again. On the downstream side of the location where the two sections are rejoined, a de-curler section 36 is interposed in the paper transport section 6.

In the humidifying de-curler unit 3, when a paper is to be humidified, the paper is transported by the first transport section 30 to the paper humidifying section 32 where the moisture from the water supply tank 31 is then added to the paper.

When a paper is not to be humidified, the paper is transported by the second transport section 35, bypassing the paper humidifying section 32. After the first transport section 30 and the second transport section 35 are rejoined, any curls that may occur on the paper are corrected at the de-curler section 36. Regardless of whether the paper is to be humidified or not to be humidified, therefore, the de-curl correction can be carried out.

The paper that is present within the humidifying de-curler unit 3 is transported by the paper transport section 6 to the paper reversing and discharging unit 4 provided on the subsequent stage.

The paper humidifying section can be of any type that humidifies the paper on which at least the first image has been transferred, but it can be of the type that is not required to humidify the paper having the second image transferred thereon. It is possible, however, that the paper humidifying section may be able to humidify the paper on which the second image has been transferred.

The paper humidifying section can be mounted in the housing within which the first image forming section is provided. For example, it may be mounted within the first image forming apparatus main body, or may be provided on the subsequent stage to the housing in which the first image forming section is provided.

in the paper reversing and discharging unit 4, a paper reversing section 40 is interposed at the paper transport section 6. The paper reversing section 40 includes a paper reversing path 41 and a bypass path 42, and can be switched between the paper reversing path 41 and the bypass path 42. When the paper is to be reversed, the paper being transported by the paper transport section 6 is led onto the paper reversing path 41 from its front end. There is then a pause. Following the pause, the paper feeding is changed from the back end to the front end of the paper and the paper is then transported to the paper transport section 6 provided on the downstream of the paper reversing section 41. In this way, the paper on the paper reversing section 6 can be turn over from the front side to the rear side. When the paper is not to be reversed, however, the paper being transported by the paper transport section 6 is not led onto the paper reversing path 41, but goes through the bypass path 42 to the paper transport section 6 on the downstream side without the paper being reversed.

Similarly to the first image forming apparatus main body 1, the second image forming apparatus main body 2 includes the second image forming section 22 which comprises a photoreceptor drum 22*a* serving as the image carrier and an image transferring section 22*b*, the electrically charging section, the light exposure section, the image developing section, the cleaning section and the like all of which are not shown. In the second image forming apparatus main body 2, an image is formed and the formed image is then transferred onto the paper. As this is described specifically, the photoreceptor drum 22*a* is electrically charged by the electrically charging section, and the light exposure section irradiates light onto the photoreceptor drum 12*a* according to the image data. An electrostatic latent image is thus formed on the photoreceptor drum 22*a*. During this process, the image data that has been adjusted to the appropriate scaling factor can be generated. In the image developing section, the electrostatic latent image is developed by applying the electrically charged toner onto the photoreceptor drum 22*a* having the electrostatic latent image formed thereon. From the photoreceptor drum 22*a* having the toner applied by the image developing section, the toner-applied image is then transferred onto the paper at the transferring position in which the transferring section 22*b* is disposed. After the toner-applied image has been transferred from the photoreceptor drum 22*a* onto the paper, any electrical charge or any toner that may remain on the photoreceptor drum 22*a* is removed by the cleaning section.

The paper having the image transferred thereon goes to the image fixing section 23 where it is heated and its image is fixed, from which it is then delivered to the subsequent stage.

It should be understood, however, that the second image forming section 22 may be the color image forming section rather than the monochrome image forming section. In the color image forming section, the photoreceptor drum as the image carrier, the electrically charging section, the light exposure section, the image developing section, the cleaning section and the like are provided for each of the colors. In addition, the second image forming section 22 include the intermediate transferring section to transfer the image on the photoreceptor drum and the second transferring section to transfer the image from the intermediate transferring section onto the paper. The intermediate transferring section corresponds to the image carrier of the present invention, and the secondary transferring section corresponds to the image transferring section of the present invention.

The first image and the second image are usually transferred onto either of the front and rear sides of the paper. It should be understood, however, that an embodiment is not limited to this embodiment described above. The first image and the second image may be formed on the same side of the paper, that is, the front side or rear side. For example, a monochrome image may be formed at either of the first and second image forming sections, while a color image may be formed at the other image forming section.

The post-processing section 5 provides the post-processing functions such as the paper folding function, the punching function, the cutting function, the pasting function and the like, but the present invention is not limited to those processing functions provided by the post-processing section 5. It should be noted that the post-processing section 5 may be omitted.

In the embodiment of the image forming apparatus described above, the first image forming section 12, the paper humidifying section 32, the paper reversing section 40 and the second image forming section 22 are housed in each of the independent casings, but the present invention is not limited to this embodiment. Rather, some or all of those sections may be housed in the same casing. The paper having the image transferred thereon at the first image forming section can be transported back to the first image forming section by the paper transport section where the image can be formed and transferred onto the paper. For this reason, the first image forming section and the second image forming section may be provided to share one common image forming section.

Figure 3:
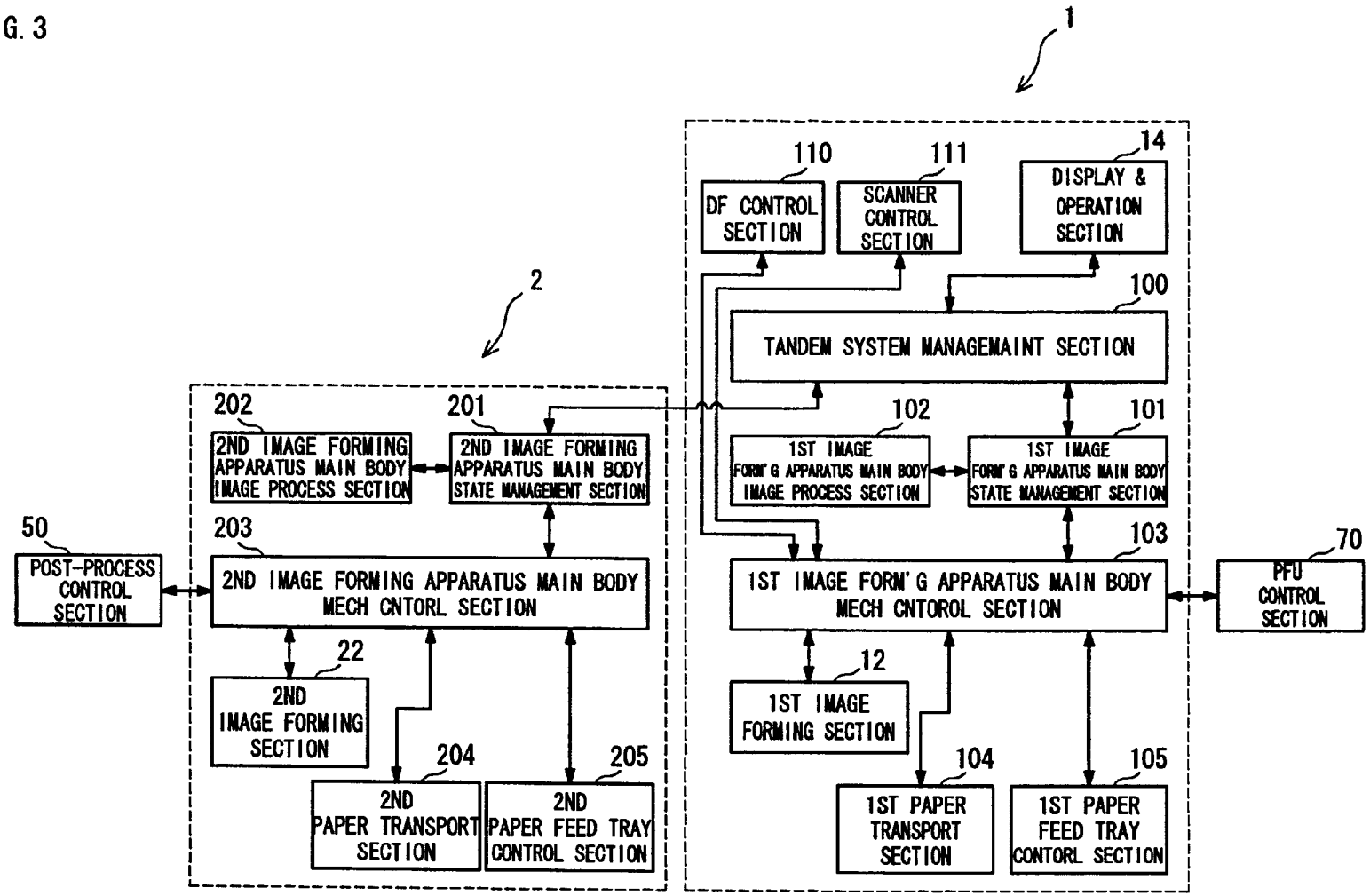
FIG. 3 is a diagram that illustrates the control blocks.

Now, the control block in the embodiment of the image forming apparatus will be described below by referring to FIG. 3.

The first image forming apparatus main body 1 includes a tandem-system management section 100 to control the entire image forming apparatus, to which the display and operation section 14 is connected so that it can be controlled by the tandem-system management section 100. Under control of the tandem-system management section 100, in this way, the information and the indication can be displayed on the display and operation section 14 so that it can be operated on by the user. The operation matter is delivered from the display and operation section 14 to the tandem-system management section 100 where the process can be performed as specified by the operation matter.

To the tandem-system management section 100 is connected the state management section 101 of the first image forming apparatus main body 1, and to the state management sector 101 of the first image forming apparatus main body 1 is connected the image processing section 102 of the first image forming apparatus main body 1.

In the state management section 101 of the first image forming apparatus main body 1, the data that is set for the first image forming apparatus main body 1, the process controlling parameters, the image scaling factors on the front side and the rear side of the paper, the transferring electric currents through the image transferring section and the like are stored. In addition, the state management section 101 of the first image forming apparatus main body 1 controls the entire first image forming apparatus main body 1, and also ascertains status of the entire first image forming apparatus main body 1.

In the image processing section 102 of the first image forming apparatus main body 1, the functions such as the analog processing function, the A/D conversion function, the shading correction function, the image compression function and the like are performed for the image data obtained from the not-shown scanner as specified by the commands from the state management section 101 of the first image forming apparatus main body 1.

To the state management section 101 of the first image forming apparatus main body 1, the mechanical control section 103 of the first image forming apparatus main body 1 is connected. To the mechanical control section 103 of the first image forming apparatus main body 1, the DF control section 110 to control the DF (document feeder) 15, the scanner control section 111 to control the not-shown scanner, the first image forming section 12, the first paper transport section 104, the first paper feeding tray control section 105, and the PFU control section 70 provided in the large-capacity paper feeding tray 7 are connected. The mechanical control section 103 of the first image forming apparatus main body 1 is provided for controlling the various mechanical elements of the first image forming apparatus main body 1 (such as a document reading function, a paper transporting function, an image forming function and the like).

As described earlier, the first image forming section 12 includes the photoreceptor drum 12*a* serving as the image carrier and the image transferring section 12*b* well as the electrically charging section, the light exposure section, the image developing section, the cleaning section and the like all of which are not shown, and is placed under control of the mechanical control section 103 of the first image forming apparatus main body 1.

The first paper transport section 104 controls the paper transport section inside the first image forming apparatus main body 1 so that paper can be transported. The first paper feeding tray control section 105 controls the paper feeding tray 10 so that paper can be fed from the paper feeding tray 10. The paper thus fed from the paper feeding tray 10 is transported by the paper transport section 6 under control of the first paper transport section 104.

The PFU control section 70 controls paper feeding tray 7 and the paper transporting. Note, however, that the respective operations of the first image forming section 12 and the first paper transport section 104 is stopped while papers are being fed by the paper feeding tray 20 within the second image forming apparatus main body 2.

Each of the sections described above, except for the PFU control section 70, are provided inside the first image forming apparatus main body 1.

Furthermore, to the tandem-system management section 100, the state management section 201 of the second image forming apparatus main body 2 is connected. To the state management section 201 of the second image forming apparatus main body 2, the image processing section 202 of the second image forming apparatus main body 2 is connected.

In the state management section 201 of the second image forming apparatus main body 2, the data that is set for the second image forming apparatus main body 2, the process control parameters, the image scaling factors on the front and rear sides of the paper, the transferring electric currents through the transferring section and the like are stored. In addition, the state management section 201 of the second image forming apparatus main body 2 controls the entire second image forming apparatus main body 2, and also ascertains status of the entire second image forming apparatus main body 2.

In the image processing section 202 of the second image forming apparatus main body 2, the analog processing function, the A/D conversion function, the shading correction function, the image compression function and the like are performed for the image data obtained from the not-shown scanner as specified by the commands from the state management section 201 of the second image forming apparatus main body 2.

To the state management section 201 of the second image forming apparatus main body 2, the mechanical control section 203 of the second image forming apparatus main body 2 is connected. To the mechanical control section 203 of the second image forming apparatus main body 2, the second image forming section 22, the second paper transport section 204, the second paper feeding tray control section 205, and the post-processing control section 50 that is provided in the post-processing section 5 are connected. The mechanical control section 203 of the second image forming apparatus main body 2 controls the various operational and functional elements (such as the document reading element, the paper feeding element, the image forming element and the like).

As described earlier, the second image forming section 22 includes the photoreceptor drum 22*a* serves as image carrier and the image transferring section 22*b* as well as the electrically charging section, the light exposure section, the image developing section, the cleaning section and the like all of which are not shown and is placed under control of the mechanical control section 203 of the second image forming apparatus main body 2.

The second paper transport section 204 controls the paper transport section inside the second image forming apparatus main body 2 so that papers can be transported. The second paper feeding tray control section 205 controls the paper feeding tray 20 so that forms can be fed from the paper feeding tray 20. The paper thus fed from the paper feeding tray 20 is transported by the paper transport section 6 under control of the second feed transport section 204.

Furthermore, to the tandem-system management section 100, the humidifying de-curler unit 3 and the paper reversing and discharging unit 4 are connected so that they can be controlled by the tandem-system management section 100. Specifically, whether the paper is to be humidified or not, whether the de-curling process is to be performed or not and whether the paper is to be reversed or not can be determined under control of the tandem-system management section 100. Thus, the tandem-system management section 100 can act as the humidity switching section and the control section provided by the present inventions.

Next, the details of what can be done on the display and operation section 14 in accordance with one embodiment of the present invention are described below.

On the display and operation section 14 according to this embodiment, it is possible to determine whether the paper humidifying section should be operated to humidify the paper or not, to set the values for the scaling factors to display the image and to set the values for the magnitude of the transferring current depending on whether the paper is to be humidified or not to be humidified.

Specifically, when the image is formed where the paper is to be humidified, the image can be formed by switching the values for the scaling factors and the values for the magnitude of the transferring electric current on the rear side of the paper that are to be set for the paper being humidified.

When the image is formed where the paper is not to be humidified, on the contrary, the image can be formed by switching the values for the scaling factors and the values for the magnitude of the transferring electric current on the rear side of the paper that are to be set for the paper not being humidified.

When the image size is changed, depending on whether the paper is to be humidified or not to be humidified, the size of the second image can become relatively smaller where the paper is not to be humidified whereas it can become relatively larger where the paper is to be humidified. The relative sizes as mentioned here mean the sizes relative to each other, that is, the size obtained where the paper is to be humidified versus the size obtained where the paper is not to be humidified. In this case, the switching can be carried out according to the rule in which the size of the second image is smaller than the size of the first image where the paper is not to be humidified, whereas the size of the second image is larger than the size of the first image where the paper is to be humidified.

When the switching is carried out for the transferring electric current depending on whether the paper is to be humidified or not to be humidified, furthermore, the transferring electric current through the second image forming section where the paper is not to be humidified can become relatively larger, and the transferring electric current through the second image forming section where the paper is to be humidified can become relatively smaller. The relative transferring electric current as mentioned here means the transferring electric currents relative to each other, that is, the current obtained where the paper is to be humidified versus the current obtained where the paper is not to be humidified.

It should be noted, in this case, that when the transferring electric current through the first image forming section and the transferring electric current through the second image forming section are equal, it is possible that the switching action is performed according to the rule that states that where the paper is not to be humidified, the transferring electric current through the second image forming section should be larger than the transferring electric current through the first image forming section and that where the paper is to be humidified, the transferring electric current through the second image forming section should be smaller than the transferring electric current through the first image forming section.

Figure 4:
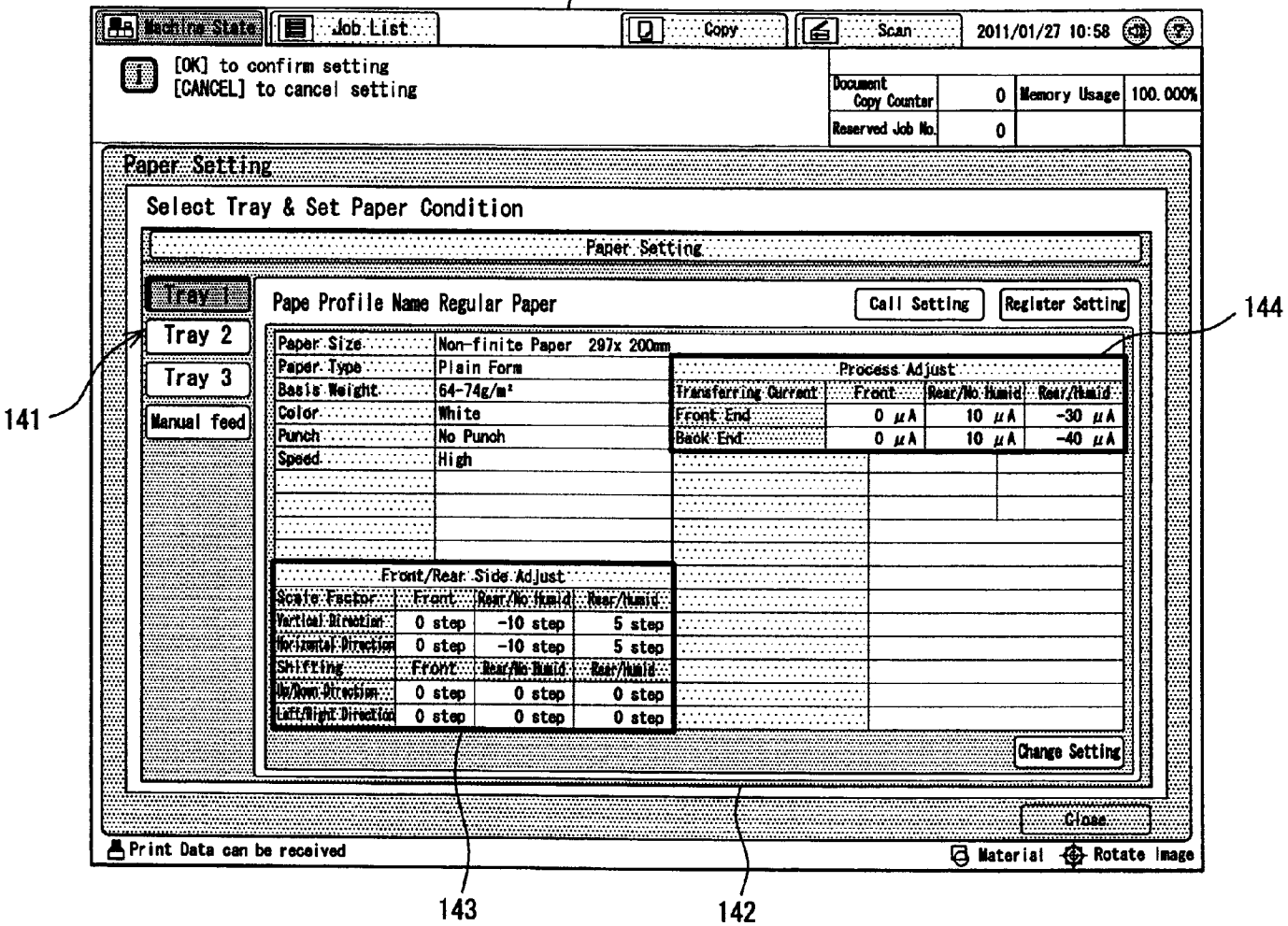
FIG. 4 is a diagram that shows the operation display screen for the display and operation section included in the image forming apparatus.

FIG. 4 illustrates the paper setting display screen 140 which will be displayed on the display and operation section 14 under control of the tandem-system management section 100.

On the paper setting display screen 140, any one of the trays can be selected by the corresponding tray selection button 141. Upon this selection, the paper setting column 142 is displayed to be operable so that the details regarding the paper setting can be specified. FIG. 4 shows that the tray 1 has been selected.

On the paper setting column 142, the respective values that have set for the paper size, the paper type, the basis weight, the color papers, the punches or none and the speed are displayed to be operable together with the front/rear side adjusting column 143 and the process adjusting column 144.

On the front/rear side adjusting column 143, the values that have been set for the scaling factor and the amount of shifting can be adjusted in the vertical and horizontal directions for the front side of the paper and for the rear side of the paper depending on whether the paper is to be humidified or not. For example, it is assumed that one step represents 0.05% for each item and that the value for each item can be set for every one step. Depending on whether the paper is to be humidified or not to be humidified, the paper may be expanded or contracted, and the values that have been set for the scaling factor on the rear side of the paper can be adjusted accordingly. Therefore, the better image can be formed by adjusting the image sizes on the front and rear sides of the paper appropriately. In FIG. 4, the front side of the paper is set to a zero (0) step, and for the paper being not to be humidified, the rear side of the paper is set to −10 steps both in the vertical and horizontal directions, that is, the image size is adjusted to be scaled down by 0.5%, and for the paper being to be humidified, the rear side of the paper is set to 5 steps both in the vertical and horizontal directions, that is, the image size is adjusted to be scaled up by 0.25%. The image shifting direction can also be switched depending on whether the paper is to be humidified or not to be humidified.

It is noted that the paper is heated when it is fixed the toner while the image is being formed on the front side of the paper, which causes some moisture to be evaporated from the paper to make the paper size smaller. If the paper is not to be humidified before the image is formed on the rear side of the paper, therefore, the image size of the rear side of the paper is made smaller relative to the size of the front side of the paper. When the paper has been humidified, it causes the paper to be expanded by absorbing the moisture. Thus, the image size of the rear side of the paper is made larger than the image size on the paper that is not humidified.

On the process adjusting, the transferring electric current for the front and back ends of the paper can be set by 1 μA step relative to the standard values. For the paper that is not to be humidified, the values for the transferring electric current for the front and back ends of the paper are set by every 10 μA so that they can become stronger relative to the standard values. For the paper that is to be humidified, the values for the transferring electric current are set by every 30 μA for the front end and by every 40 μA for the back end so that they can become weaker relative to the standard values.

When the paper is heated, its resistance will be increased because it loses the moisture. For the paper that is not to be humidified, therefore, the values for the transferring electric current will be set to be stronger than those when the image is formed on the front side of the paper. For the paper that has been humidified, on the contrary, it will absorb the moisture and its resistance will thus be decreased. The values for the transferring electric current are set to be weaker than the values for the paper that is not to be humidified.

In this example, the values for the transferring electric current can be set for the front and back ends of the paper, but those values can be adjusted for the division of the paper or only for the paper on block.

In the above example, it is assumed that the values of the set for the scaling factor on the front and rear sides of the paper and the values of the set to be stronger/weaker for the transferring electric current are used in the set for the tray. Those values may be named and registered as the paper profile. The paper profile can be called, and the values in the name profile can be applied to any desired tray.

Figure 5:
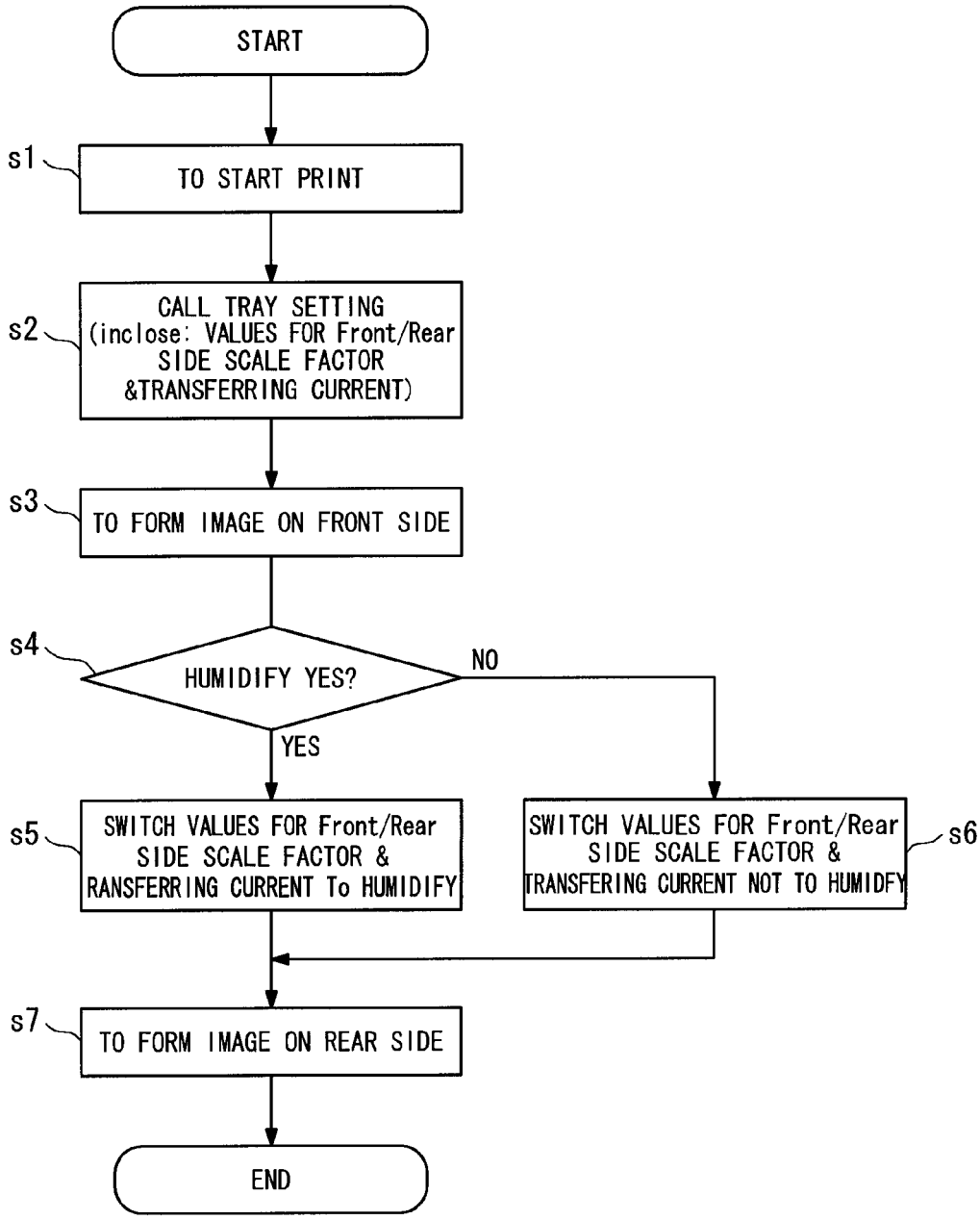
FIG. 5 is a flowchart diagram that illustrates the blocks in the procedure of switching the image formation control according to whether the paper is to be humidified or not to be humidified.

Now, the control procedure that allows the image formation control to be switched depending on whether the paper is to be humidified or not to be humidified is described by referring to the flowchart shown in FIG. 5. The following control procedure is performed by the tandem-system management section 100.

It is assumed that the double-sided printing is performed as specified by the commands from the operator. When the printing is started (step s1), the tray setting data as specified is read (step s2). The tray setting data includes the values that are set for the scaling factor on the front and rear sides of the paper and the values that are set for the transferring electric current as shown in FIG. 4, both of which can be set according to whether the paper is to be humidified or not to be humidified. The tray setting data that has been read can not be used. In this case, the values for the scaling factor on the front and rear sides of the paper and the values for the transferring electric current can be set and entered on the display and operation section 14 depending on whether the paper is to be humidified or not to be humidified.

Following the above processing step, in the first image forming section 12 within the first image forming apparatus main body 1, the image is formed on the front side of the paper as specified by the respective values that have been set for the front and rear side scaling factor and for the transferring electric currents when the tray has been selected. After the image is formed and then transferred onto the paper at the transferring section 12*b* (step s3), the paper is transported by the transport section 6 to the fixing section 13 where the paper is fixed, and the paper is then led to the humidifying de-curler unit 3.

In the tandem-system management section 100, it is performed to determine whether the paper is to be humidified or not to be humidified by checking of job setting et cetera (step s4). The determination whether the paper is to be humidified or not to be humidified may be done manually or may be performed automatically in accordance with the particular type or basis weight of the paper.

In the tandem-system management section 100, when it is determined that the paper is to be humidified (YES in step s4), the front/rear side scaling factor and the magnitude of the transferring electric current on the rear side of the paper is switched where the paper is to be humidified (step s5). When the paper is not to be humidified (NO in step s4), the front/rear side scaling factor and the magnitude of the transferring electric current on the rear side of the paper is switched where the paper is not to be humidified (step s6).

Furthermore, the humidifying de-curler unit 3 is controlled, depending on whether it is determined that the paper is to be humidified or not. When the paper is to be humidified, the paper is humidified at the humidifying de-curler unit 3 and is then transported by the transport section 6, and when the paper is not to be humidified, the paper is transported by the transport section 6 without being humidified at the humidifying de-curler unit 3.

The paper that has exited out of the humidifying de-curler unit 3 is then introduced into the paper reversing and discharging unit 4. As the front and rear printing is set in this example, the paper is transported along the reversing path 41 where the paper is reversed by the paper reversing section 40, and the thus reversed paper is then transported through the transport section 6 to the second image forming apparatus main body 2.

In the second image forming apparatus main body 2, the image is formed on the rear side of the paper according to the particular respective values for the front/rear side scaling factor and for the transferring electric current that have been switched in accordance with whether the paper is to be humidified or not to be humidified (step s7).

Following this step, the post-processing step may be performed or not depending on the particular values that have been set as described above. In either case, the paper goes out of the image forming apparatus and the printing is finished.

Specifically, the embodiment allows the image formation control to be switched depending on whether the paper is being humidified or not being humidified before the second image is transferred onto the paper having the first image already transferred thereon, thereby any wrong image size or any defective image can thus be avoided and allowing the appropriate image formation to be performed according to the state of the paper that may be varied depending on whether the paper is being humidified or not being humidified.

In the following description, it is assumed that with the tray 1 being selected, the following jobs are executed in accordance with the above described control procedure, depending on whether the paper is to be humidified or not to be humidified. It is then supposed that where the paper is not to be humidified, the image size on the rear side of the paper is set to be reduced by 0.5%, and the transferring electric current is set to become stronger by 10 μA both on the front and back ends relative to the respective standard values. Where the paper is to be humidified, the image size on the rear side of the paper is set to be enlarged by 0.25%, and the transferring electric current is set to be weaker by 30 μA on the front end and by 40 μA on the back ends relative to the respective standard values.

Job A: A4 Double-Sided Printing Not Humidified 10 sheets 5 copies

Job B: A4 Double-Sided Printing Humidified 5 sheets 10 copies

Job C: A4 Double-Sided Printing Not Humidified 10 sheets 10 copies

For the printing that is performed by executing the job A, because it is determined that the paper is not to be humidified, the image formation control is switched to where the paper is not to be humidified, and performed by using the respective values that have been set for the front/rear side scaling factor and for the transferring electric current on the display and operation section when the image is to be formed on the rear side of the paper. That is, the image formation is carried out with the image size being set to be reduced by 0.5% and the transferring electric current being set to become stronger by 10 μA relative to the respective standard values.

For the printing that is performed by executing the job B, because the paper is to be humidified, the image formation control is switched to where the paper is to be humidified, and performed by using the respective values that have been set for the front/rear side scaling factor and for the transferring electric current on the display and operation section where the image is to be formed on the rear side of the paper. That is, the image formation is carried out with the image size being set to be enlarged by 0.25% and the transferring electric current being set to become weaker by 30 μA on the front end and by 40 μA on the back end relative to the respective standard values.

For the printing that is performed by executing the job C, because the paper is not to be humidified, the image formation control is switched and the image formation is carried out as for the job A.

As the typical case in which the image formation control is switched depending whether the paper is to be humidified on the paper having the first image transferred thereon, there is the case in which the size of the image or the magnitude of the transferring electric current is switched as described above. The present invention is not limited to this embodiment described above, but other elements may be switched other elements control.

In the above described embodiment, which the image forming apparatus has the tandem-system configuration that includes the two image forming apparatus main bodies which are arranged in series with each other and between which the paper humidifying unit is interposed, but the image forming apparatus may be configured to include a single image forming apparatus main body in which the paper humidifying unit is provided within the transport path from the toner fixing section to the location where the image is printed on the rear side of the paper.

Although the present invention has been described with reference to the particular embodiments, it should be understood that the present invention is not limited to those particular embodiments, and various changes, modification or alterations may be made as appropriate without departing from the spirit and scope of the present invention as defined in the appended claims.

What is claimed is:

1. An image forming apparatus including:

a first image forming section to form a first image onto an image carrier and transfer the formed first image onto a paper;

a paper humidifying section to humidify the paper onto which at least the first image has been transferred;

a humidity switching section operated to switch between where the paper is to be humidified and where the paper is not to be humidified by the paper humidifying section;

a second image forming section to form a second image onto the image carrier and transfer the formed second image onto the paper;

a paper transporting section to transport the paper from the first image forming section to the second image forming section; wherein a control section to control the first image forming section and second image forming section wherein the control section is operated to switch the image formation control at the second image forming section depending on whether the paper is to be humidified or not at the paper humidifying section.

2. The image forming apparatus as defined in claim 1, wherein the first image forming section and the second image forming section are provided to share one common image forming section, and the paper transport section is operated so that the paper discharged from the image forming section and reversed the front and the rear side by a paper reversing section can be transported through the paper reversing section back to the common image forming section in which the image can be formed onto the paper.

3. The image forming apparatus as defined in claim 1, wherein the paper transport section includes a paper reversing section to reverse the front and the rear side of the paper.

4. The image forming apparatus as defined in claims 1, wherein the control section is operated to permit the size of the second image to be changed, depending on whether the paper is to be humidified or not by the paper humidifying section.

5. The image forming apparatus as defined in claim 4, wherein the size of the second image is changed so that the size of the second image can become relatively smaller where the paper is not to be humidified and can become relatively larger where the paper is to be humidified.

6. The image forming apparatus as defined in claims 1, wherein the control section is operated so that the magnitude of the transferring electric current through the transferring section in the second image forming section can be switched to become larger or smaller, depending on whether the paper is to be humidified or not by the paper humidifying section.

7. The image forming apparatus as defined in claim 6, wherein the magnitude of the transferring electric current is switched so that the transferring electric current through the second image forming section can become relatively larger where the paper is not to be humidified, and can become relatively smaller where the paper is to be humidified.

8. The image forming apparatus as defined in claims 1, further including a display and operation section, wherein the display and operation section accepts the entering by the operator, and the display and operation section includes a function that allows the image formation control by the second image forming section to be set, depending on whether the paper is to be humidified or not by the paper humidifying section.

9. The image forming apparatus as defined in claim 8, wherein the display and operation section includes a function that allows the scaling factor of the first image and the scaling factor of the second image to be set respectively, depending on whether the paper is to be humidified or not to be humidified.

10. The image forming apparatus as defined in claim 8, wherein the display and operation section includes a function that allows the magnitude of the transferring electric current through the first image forming section and the magnitude of the transferring electric current through the second image forming section to be set respectively, depending on whether the paper is to be humidified or not to be humidified.

11. The image forming apparatus as defined in claims 8, wherein the control section is operated to permit the image formation control at the second image forming section to be switched, depending on the setting at the display and operation section.

* * * * *